US012290734B2

(12) United States Patent
Cao

(10) Patent No.: US 12,290,734 B2
(45) Date of Patent: May 6, 2025

(54) ENTERTAINMENT AND LEISURE DEVICE AND METHOD OF INSTALLING SAME

(71) Applicant: Taizhou Sen Kang Protective Equipment Factory, Taizhou (CN)

(72) Inventor: Senkang Cao, Taizhou (CN)

(73) Assignee: Taizhou Sen Kang Protective Equipment Factory, Taizhou (CN)

( * ) Notice: Subject to any disclaimer, the term of this patent is extended or adjusted under 35 U.S.C. 154(b) by 69 days.

(21) Appl. No.: 18/226,417

(22) Filed: Jul. 26, 2023

(65) Prior Publication Data

US 2025/0032836 A1 Jan. 30, 2025

(51) Int. Cl.

| | |
|---|---|
| ***A63B 7/02*** | (2006.01) |
| ***A63B 9/00*** | (2006.01) |
| ***A63B 17/00*** | (2006.01) |
| ***A63G 9/00*** | (2006.01) |

(52) U.S. Cl.

CPC ..... *A63B 7/02* (2013.01); *A63B 17/00* (2013.01); *A63G 9/00* (2013.01); *A63B 2009/002* (2013.01); *A63B 2009/006* (2013.01); *A63B 2225/093* (2013.01)

(58) Field of Classification Search

CPC ..... A63B 7/00; A63B 7/08; A63B 7/085

See application file for complete search history.

(56) References Cited

U.S. PATENT DOCUMENTS

| | | | | |
|---|---|---|---|---|
| 6,338,700 | B1 * | 1/2002 | Pollock | A63B 23/03575 482/904 |
| 11,529,536 | B1 * | 12/2022 | Ferreira | A63G 31/00 |
| 2017/0319887 | A1 * | 11/2017 | O'Brien | F16B 45/023 |
| 2018/0185690 | A1 * | 7/2018 | Coulter | A63B 71/03 |
| 2020/0298041 | A1 * | 9/2020 | Liu | A63B 9/00 |
| 2022/0241638 | A1 * | 8/2022 | Peery | A63B 21/16 |
| 2023/0109554 | A1 * | 4/2023 | Sargent | A63B 7/085 482/34 |
| 2023/0330467 | A1 * | 10/2023 | Sargent | A63B 7/085 |

* cited by examiner

*Primary Examiner* — Nyca T Nguyen
(74) *Attorney, Agent, or Firm* — Birchwood IP

(57) ABSTRACT

The present disclosure relates to an entertainment and leisure device and a method of installing the same. The entertainment and leisure device comprises: a bundling belt, which is fixed on a cylinder; a ribbon, which is fixed between two cylinders through two bundling belts, wherein the bundling belts are used to adjust the hanging length of the ribbon, and fixed points are marked on the ribbon; self-locking sliding buckles, wherein the upper ends of the self-locking sliding buckles penetrate through the ribbon, and the self-locking sliding buckles are distributed at a plurality of fixed points of the ribbon; a lock buckle, which penetrates through the lower end of the self-locking sliding buckle; and an interactive component, the upper end of which is hung on the lock buckle, and the lower end of which is provided with an interactive accessory for climbing and/or grabbing and/or riding.

9 Claims, 2 Drawing Sheets

ENTERTAINMENT AND LEISURE DEVICE AND METHOD OF INSTALLING SAME

TECHNICAL FIELD

The present disclosure relates to the technical field of fitness devices, in particular to an entertainment and leisure device and a method of installing the same.

BACKGROUND

In the existing leisure devices, a single-piece fitness device such as a lifting ring is fixed with nylon slings by stitching, and there are many different single-piece fitness devices on a leisure device. However, this production method requires a specific use space when the device is used outdoors, and brings the problem that the devices cannot be used when two preset hanging positions do not meet the requirements.

Therefore, there is an urgent need for an entertainment and leisure device and a method of installing the same. The entertainment and leisure device is provided with fitness accessories with adjustable hanging positions, so as to improve the adaptability of different hanging lengths in various scenarios.

SUMMARY

The present disclosure provides an entertainment and leisure device and a method of installing the same. The entertainment and leisure device is provided with fitness accessories with adjustable hanging positions, so as to improve the adaptability of different hanging lengths in various scenarios, and solve the technical problem that the devices cannot be used when two preset hanging positions do not meet the requirements.

In order to solve the above technical problems, on the one hand, the present disclosure discloses an entertainment and leisure device and a method of installing the same, wherein the entertainment and leisure device is hung on two cylinders, comprising:

- a bundling belt, which is fixed on the cylinder;
- a ribbon, which is fixed between two cylinders through two bundling belts, wherein the bundling belts are used to adjust the hanging length of the ribbon, and fixed points are marked on the ribbon;
- self-locking sliding buckles, wherein the upper ends of the self-locking sliding buckles penetrate through the ribbon, and the self-locking sliding buckles are distributed at a plurality of fixed points of the ribbon;
- a lock buckle, which penetrates through the lower end of the self-locking sliding buckle; and
- an interactive component, the upper end of which is hung on the lock buckle, and the lower end of which is provided with an interactive accessory for climbing and/or grabbing and/or riding.

Preferably, the self-locking sliding buckle is provided as a hollow shell, a separator plate is provided in the self-locking sliding buckle, the ribbon is clamped on the separator plate, the lower end of the separator plate extends out of the shell, and an exposed part is provided with a through hole.

Preferably, the lock buckle penetrates through the through hole of the self-locking sliding buckle, one side of the lock buckle is provided with an opening, nuts penetrate through both ends of the opening, and the nuts are in threaded connection with the opening for ascending or descending to either side to open or close the opening.

Preferably, the thickness of the shell of the self-locking sliding buckle is less than 0.8 mm, the self-locking sliding buckle is used to be fixed and locked on the ribbon when the ribbon is tight, and the self-locking sliding buckle is also used to slide on the ribbon when the ribbon is loose.

Preferably, a rope is provided above the interactive component, a lifting ring is provided at one side of the rope, and the lifting ring penetrates through the lock buckle.

Preferably, the interactive accessory is provided with a first interactive accessory, a second interactive accessory, a third interactive accessory and a fourth interactive accessory; the first interactive accessory is provided with a hanging net or a ladder for climbing, the second interactive accessory is provided with a wheel disc or a lifting ring or a handle for grabbing, the third interactive accessory is provided with a swing or a chassis for sitting or standing, and the fourth interactive accessory is provided with a pulley accessory for sliding along the ribbon from one end to the other end.

Preferably, the pulley accessory is provided with a triangular lock buckle, and the second interactive accessory or the third interactive accessory is hung below the triangular lock buckle.

Preferably, the first interactive accessory, the second interactive accessory and the third interactive accessory are hung on the fixed points of the ribbon, and the ribbon is made of nylon.

Preferably, the bundling belt and the ribbon are made of nylon or polyester fiber.

On the other hand, the present disclosure discloses a method of installing an entertainment and leisure device, wherein the bundling belt adjusts the hanging length of the ribbon, and fixed points are marked on the ribbon, in which the method comprises:

- providing an identification mark at each of the fixed points, wherein the identification mark is used to identify the safe hanging position when the ribbon is provided with cylinders in different length ranges, wherein
- the ribbon is provided with a first hanging length and a second hanging length, both ends of the first hanging length exceed half of the second hanging length,
- the first hanging length and the second hanging length are provided with a first group of hanging positions and a second group of hanging positions, respectively, the first group of hanging positions and the second group of hanging positions are both uniformly distributed from the midpoint to both sides of the ribbon, the spacing of the first group of hanging positions is greater than that of the second group of hanging positions, and the spacing of the second group of hanging positions is less than two thirds of that of the first group of hanging positions,
- each group of hanging points is provided with one or two hanging points, and the spacing L between two hanging points of each group of hanging points is preset to be 20 cm≤L≤50 cm.

Compared with the prior art, the entertainment and leisure device provided by the present disclosure has the following beneficial effects.

The bundling belt can be used to adjust the hanging length of the ribbon to meet different needs. Fixed points are marked on the ribbon, so that users can conveniently determine the hanging length and various hanging points. The device further comprises a self-locking sliding buckle. This design allows users to adjust the hanging position by moving the self-locking sliding buckle to meet personal needs and expand the adaptability of different scenarios. The interactive component is hung on the lock buckle, providing the functions of climbing, grabbing and riding. This design provides an entertainment facility with simple structure, reasonable setting, flexibility and easy adjustment of hanging length, which enables users to enjoy entertainment and leisure activities according to their own needs and preferences, and choose different interactive modes, thus increasing the interest and diversity of the entertainment and leisure device.

In addition, according to the installation method provided by the present disclosure, the hanging length of the ribbon is adjusted through the bundling belt, and fixed points are marked on the ribbon. The method comprises providing an identification mark at each of the fixed points, wherein the identification mark is used to identify the safe hanging position when the ribbon is provided with cylinders in different length ranges, so that the environmental adaptability of the device can be enhanced while improving the safety.

BRIEF DESCRIPTION OF DRAWINGS

The accompanying drawings are provided to provide a further understanding of the present disclosure and constitute a part of the specification. Together with the embodiments of the present disclosure, the accompanying drawings serve to explain the present disclosure, rather than constitute a limitation of the present disclosure. In the accompanying drawings.

In the figures.

1. Bundling belt; 2. Ribbon; 3. Self-locking sliding buckle; 31. Separator plate; 32. Through hole; 4. Lock buckle; 41. Nut; 5. Interactive component; 51. Rope; 52. Lifting ring; 53. Pulley accessory; 54. Triangular lock buckle; 6. Cylinder.

DETAILED DESCRIPTION

The specific embodiments of the present disclosure will be described in further detail hereinafter with reference to the attached drawings and embodiments. The following embodiments are used to illustrate the present disclosure, rather than limit the scope of the present disclosure.

In the description of the present disclosure, it should be understood that the orientational or positional relationships indicated by the terms such as "center", "up", "down", "front", "back", "left", "right", "vertical", "horizontal", "top", "bottom", "inside", and "outside", are based on the orientational or positional relationships shown in the accompanying drawings only for the convenience of describing the present disclosure and simplifying the description, rather than indicate or imply that the referred devices or elements must have a specific orientation, be constructed and operated in a specific orientation, and therefore should not be construed as limiting the present disclosure.

The terms such as "first" and "second" are only used for the purpose of description, and cannot be understood as indicating or implying relative importance or implicitly indicating the number of indicated technical features. Therefore, the features defined with "first" and "second" can include one or more of the features explicitly or implicitly. In the description of the present disclosure, "a plurality of" means two or more, unless otherwise specifically defined.

In the present disclosure, it should be noted that unless otherwise specified and defined expressly, the terms such as "mount", "link", and "connect" should be understood broadly, for example, it can be fixed connection, detachable connection or integral connection; or mechanical connection or electrical connection; or direct connection or indirect connection through an intermediate medium; or internal communication between two elements. For those skilled in the art, the specific meanings of the above terms in the present disclosure can be understood according to specific situations.

Figure 1:
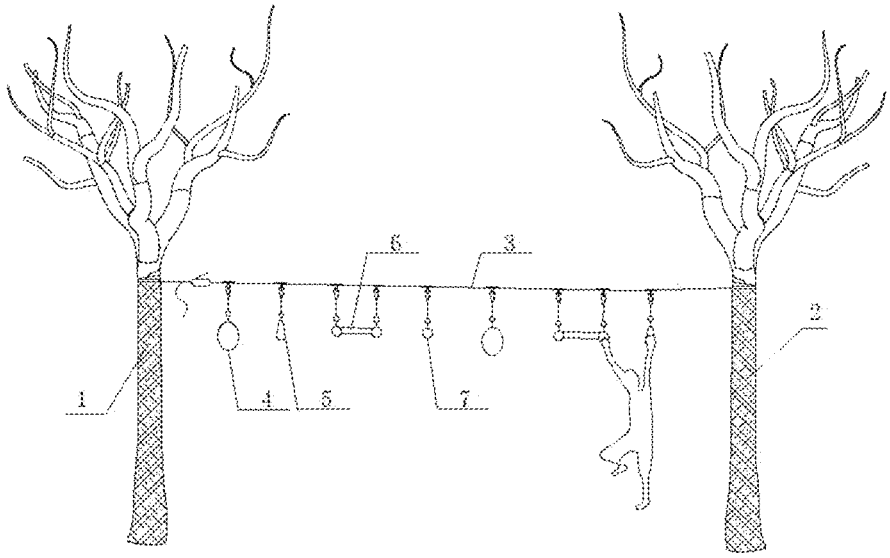
FIG. 1 is a schematic structural diagram of an entertainment and leisure device according to the present disclosure.

Referring to FIG. 1, on the one hand, this embodiment discloses an entertainment and leisure device and a method of installing the same. The entertainment and leisure device is hung on two cylinders 6, comprising: a bundling belt 1, a bundling belt 1, a ribbon 2, a self-locking sliding buckle 3, a lock buckle 4 and an interactive component 5. The bundling belt 1 is fixed on the cylinder 6. The ribbon 2 is fixed between the two cylinders 6 through two bundling belts 1. The bundling belts 1 are used to adjust the hanging length of the ribbon 2, and fixed points are marked on the ribbon 2. The self-locking sliding buckles 3 are provided, wherein the upper ends of the self-locking sliding buckles 3 penetrate through the ribbon 2, and the self-locking sliding buckles 3 are distributed at a plurality of fixed points of the ribbon 2. The lock buckle 4 penetrates through the lower end of the self-locking sliding buckle 3. The upper end of the interactive component 5 is hung on the lock buckle 4, and the lower end of the interactive component is provided with an interactive accessory for climbing and/or grabbing and/or riding.

Specifically, the bundling belt 1 is a ratchet bundling belt.

Figure 2:
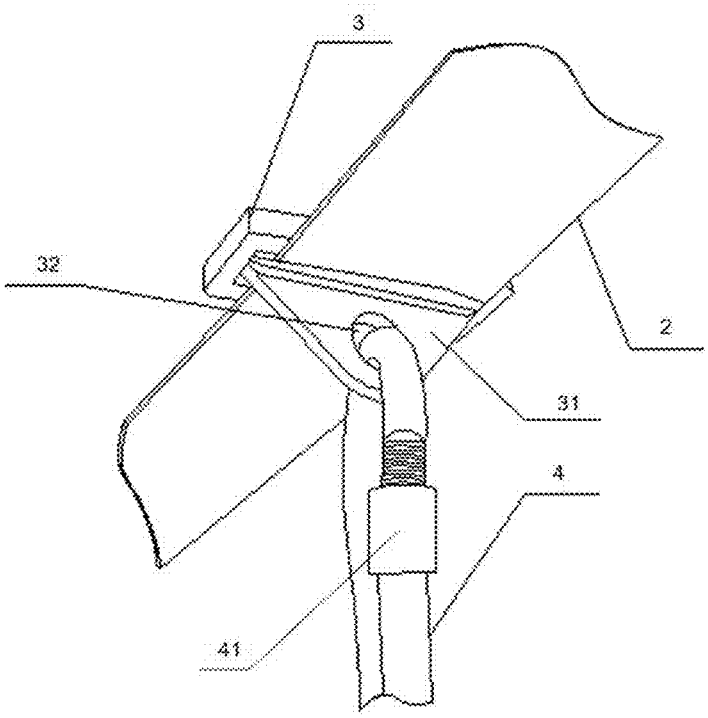
FIG. 2 is a schematic structural diagram of a self-locking sliding buckle and a lock buckle of an entertainment and leisure device according to the present disclosure.

Referring to FIG. 2, in some embodiments of the present disclosure, the self-locking sliding buckle 3 is provided as a hollow shell, and a separator plate 31 is provided in the self-locking sliding buckle. The ribbon 2 is clamped on the separator plate 31. The lower end of the separator plate 31 extends out of the shell, and an exposed part is provided with a through hole 32.

Referring to FIG. 2, in some embodiments of the present disclosure, the lock buckle 4 penetrates through the through hole 32 of the self-locking sliding buckle 3. One side of the lock buckle 4 is provided with an opening. Nuts 41 penetrate through both ends of the opening. The nuts 41 are in threaded connection with the opening for ascending or descending to either side to open or close the opening.

Referring to FIG. 2, in some embodiments of the present disclosure, the thickness of the shell of the self-locking sliding buckle 3 is less than 0.8 mm, the self-locking sliding buckle 3 is used to be fixed and locked on the ribbon 2 when the ribbon 2 is tight, and the self-locking sliding buckle 3 is also used to slide on the ribbon 2 when the ribbon 2 is loose.

Referring to FIG. 1, in some embodiments of the present disclosure, a rope 51 is provided above the interactive component 5, a lifting ring 52 is provided at one side of the rope 51, and the lifting ring 52 penetrates through the lock buckle 4.

Referring to FIG. 1, in some embodiments of the present disclosure, the interactive accessory is provided with a first interactive accessory, a second interactive accessory, a third interactive accessory and a fourth interactive accessory; the first interactive accessory is provided with a hanging net or a ladder for climbing, the second interactive accessory is provided with a wheel disc or a lifting ring 52 or a handle for grabbing, the third interactive accessory is provided with a swing or a chassis for sitting or standing, and the fourth interactive accessory is provided with a pulley accessory 53 for sliding along the ribbon 2 from one end to the other end.

Referring to FIG. 1, in some embodiments of the present disclosure, the pulley accessory 53 is provided with a triangular lock buckle 54, and the second interactive accessory or the third interactive accessory is hung below the triangular lock buckle 54.

Specifically, the pulley accessory 53 is provided with a roller shaft, a roller and a roller frame. The roller shaft is provided above the roller frame. The roller penetrates through the roller shaft. A hole is provided below the roller frame. The triangular lock buckle 54 penetrates through the hole, and the ribbon 2 penetrates between the roller and the roller frame.

Referring to FIG. 1, in some embodiments of the present disclosure, the first interactive accessory, the second interactive accessory and the third interactive accessory are hung on the fixed points of the ribbon 2, and the ribbon 2 is made of nylon.

Referring to FIGS. 1 to 2, in some embodiments of the present disclosure, the bundling belt 1 and the ribbon 2 are made of nylon or polyester fiber.

Figure 3:
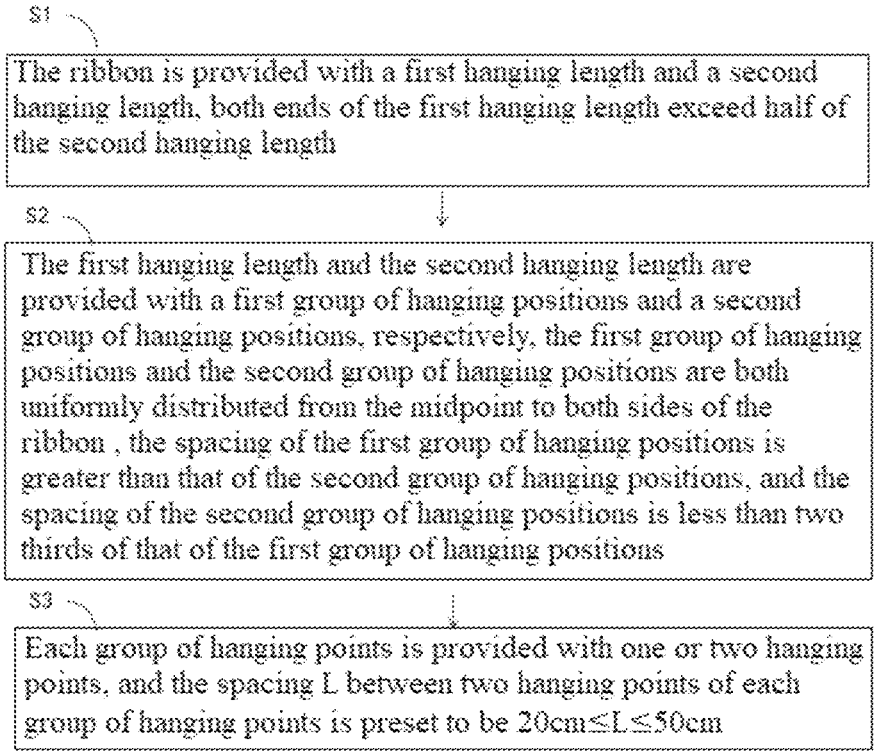
FIG. 3 is a flow chart of a method of installing an entertainment and leisure device according to the present disclosure.

On the other hand, as shown in FIG. 3, this embodiment discloses a method of installing an entertainment and leisure device. The bundling belt 1 adjusts the hanging length of the ribbon 2, and fixed points are marked on the ribbon 2, in which the method comprises:

providing an identification mark at each of the fixed points, wherein the identification mark is used to identify the safe hanging position when the ribbon 2 is provided with cylinders 6 in different length ranges, wherein Step S1: the ribbon 2 is provided with a first hanging length and a second hanging length, both ends of the first hanging length exceed half of the second hanging length;

Step S2: the first hanging length and the second hanging length are provided with a first group of hanging positions and a second group of hanging positions, respectively, the first group of hanging positions and the second group of hanging positions are both uniformly distributed from the midpoint to both sides of the ribbon 2, the spacing of the first group of hanging positions is greater than that of the second group of hanging positions, and the spacing of the second group of hanging positions is less than two thirds of that of the first group of hanging positions;

Step S3: each group of hanging points is provided with one or two hanging points, and the spacing L between two hanging points of each group of hanging points is preset to be 20 cm≤L≤50 cm.

Compared with the prior art, the entertainment and leisure device provided by the present disclosure has the following beneficial effects.

The bundling belt 1 can be used to adjust the hanging length of the ribbon 2 to meet different needs. Fixed points are marked on the ribbon 2, so that users can conveniently determine the hanging length and various hanging points. The device further comprises a self-locking sliding buckle 3. This design allows users to adjust the hanging position by moving the self-locking sliding buckle 3 to meet personal needs and expand the adaptability of different scenarios. The interactive component 5 is hung on the lock buckle 4, providing the functions of climbing, grabbing and riding. This design provides an entertainment facility with simple structure, reasonable setting, flexibility and easy adjustment of banging length, which enables users to enjoy entertainment and leisure activities according to their own needs and preferences, and choose different interactive modes, thus increasing the interest and diversity of the entertainment and leisure device.

In addition, according to the installation method provided by the present disclosure, the hanging length of the ribbon 2 is adjusted through the bundling belt 1, and fixed points are marked on the ribbon 2. The method comprises providing an identification mark at each of the fixed points, wherein the identification mark is used to identify the safe hanging position when the ribbon 2 is provided with cylinders 6 in different length ranges, so that the environmental adaptability of the device can be enhanced while improving the safety.

It should be understood by those skilled in the art that embodiments of the present disclosure can be provided as a method, a system, or a computer program product. Therefore, the present disclosure can take the form of an entirely hardware embodiment, an entirely software embodiment, or an embodiment combining software and hardware aspects. Moreover, the present disclosure can take the form of a computer program product implemented on one or more computer-usable storage media (including but not limited to a disk storage, a CDROM, an optical storage, etc.) containing computer-usable program codes.

Finally, it should be noted that the above embodiments are only used to illustrate the technical scheme of the present disclosure, rather than limit the technical scheme. Although the present disclosure has been described in detail with reference to the above embodiments, those skilled in the art should understand that the specific embodiments of the present disclosure can still be modified or replaced equivalently. Any modification or equivalent replacement without deviating from the spirit and scope of the present disclosure should be included in the scope of protection of the present disclosure.

What is claimed is:

1. An entertainment and leisure device hung on two cylinders, comprising:

two bundling belts, which are fixed on the two cylinders;

a ribbon, which is fixed between the two cylinders through the two bundling belts, wherein the two bundling belts are used to adjust a hanging length of the ribbon, and fixed points are marked on the ribbon;

self-locking sliding buckles, wherein upper ends of the self-locking sliding buckles penetrate through the ribbon, and the self-locking sliding buckles are distributed at a plurality of fixed points of the ribbon;

a lock buckle, which penetrates through lower ends of the self-locking sliding buckles; and an interactive component, an upper end of which is hung on the lock buckle, and a lower end of which is provided with an interactive accessory for climbing and/or grabbing and/or riding:

wherein the self-locking sliding buckles are provided as hollow shells, a separator plate is provided in the self-locking sliding buckles, the ribbon is clamped on the separator plate, a lower end of the separator plate extends out of the hollow shells, and an exposed part is provided with a through hole.

2. The entertainment and leisure device according to claim 1, wherein the lock buckle penetrates through the through hole of the self-locking sliding buckles, one side of the lock buckle is provided with an opening, nuts penetrate through both ends of the opening, and the nuts are in threaded connection with the opening for ascending or descending to either side to open or close the opening.

3. The entertainment and leisure device according to claim 2, wherein thicknesses of the hollow shells of the self-locking sliding buckles are less than 0.8 mm, the self-locking sliding buckles are used to be fixed and locked on the ribbon when the ribbon is tight, and the self-locking sliding buckles are also used to slide on the ribbon when the ribbon is loose.

4. The entertainment and leisure device according to claim 3, wherein a rope is provided above the interactive component, a lifting ring is provided at one side of the rope, and the lifting ring penetrates through the lock buckle.

5. The entertainment and leisure device according to claim 4, wherein the interactive accessory is provided with a first interactive accessory, a second interactive accessory, a third interactive accessory and a fourth interactive accessory;

the first interactive accessory is provided with a hanging net or a ladder for climbing, the second interactive accessory is provided with a wheel disc or the lifting ring or a handle for grabbing, the third interactive accessory is provided with a swing or a chassis for sitting or standing, and the fourth interactive accessory is provided with a pulley accessory for sliding along the ribbon from one end to the other end.

6. The entertainment and leisure device according to claim 5, wherein the pulley accessory is provided with a triangular lock buckle, and the second interactive accessory or the third interactive accessory is hung below the triangular lock buckle.

7. The entertainment and leisure device according to claim 6, wherein the first interactive accessory, the second interactive accessory and the third interactive accessory are hung on the fixed points of the ribbon, and the ribbon is made of nylon.

8. The entertainment and leisure device according to claim 7, wherein the two bundling belts and the ribbon are made of nylon or polyester fiber.

9. A method of installing an entertainment and leisure device, which is applied to the entertainment and leisure device according to claim 1, wherein the two bundling belts adjust the hanging length of the ribbon, and fixed points are marked on the ribbon, in which the method comprises:

providing an identification mark at each of the fixed points, wherein the identification mark is used to identify a safe hanging position when the ribbon is provided with cylinders in different length ranges, wherein the ribbon is provided with a first hanging length and a second hanging length, both ends of the first hanging length exceed half of the second hanging length, the first hanging length and the second hanging length are provided with a first group of hanging positions and a second group of hanging positions, respectively, the first group of hanging positions and the second group of hanging positions are both uniformly distributed from the midpoint to both sides of the ribbon, a spacing of the first group of hanging positions is greater than that of the second group of hanging positions, and a spacing of the second group of hanging positions is less than two thirds of that of the first group of hanging positions, each group of hanging points is provided with one or two hanging points, and a spacing L between two hanging points of each group of hanging points is preset to be 20 cm≤L≤50 cm.

* * * * *